US005647781A

United States Patent [19]

Johnson, Sr.

[11] Patent Number: 5,647,781

[45] Date of Patent: Jul. 15, 1997

[54] OUTBOARD MOTOR SUPPORT

[76] Inventor: Calvin D. Johnson, Sr., 7701 Samet Dr., High Point, N.C. 27265

[21] Appl. No.: 720,045

[22] Filed: Sep. 27, 1996

[51] Int. Cl.[6] ..... B63H 20/06

[52] U.S. Cl. ..... 440/53; 248/640; 440/900

[58] Field of Search ..... 440/900, 53, 63, 440/55, 59; 403/93, 95, 97, 103, 324–331, 150, 154, 166; 248/640–643

[56] References Cited

U.S. PATENT DOCUMENTS

| | | | |
|---|---|---|---|
| 2,287,117 | 6/1942 | Montalto | 403/324 |
| 4,564,308 | 1/1986 | Ikegami et al. | 403/166 |
| 4,826,460 | 5/1989 | Zuckerman | 440/55 |
| 5,021,016 | 6/1991 | Currey | 440/113 |
| 5,031,842 | 7/1991 | Mohr | 440/900 |
| 5,107,786 | 4/1992 | Templeman | 114/280 |
| 5,393,251 | 2/1995 | Gilbert | 248/640 |
| 5,398,569 | 3/1995 | Carr | 403/166 |

*Primary Examiner*—Edwin L. Swinehart

[57] ABSTRACT

An outboard motor support for preventing damage from inadvertent pivoting of the motor during trailering is provided which includes a pair of spring-loaded locking pins for convenient placement and removal. The support is attached to the motor and boat without making modifications thereto and handles are affixed to the spring-loaded locking pins for easy manipulation. Two embodiments of the outboard motor support are provided to accommodate the different popular types of outboard motors.

8 Claims, 5 Drawing Sheets

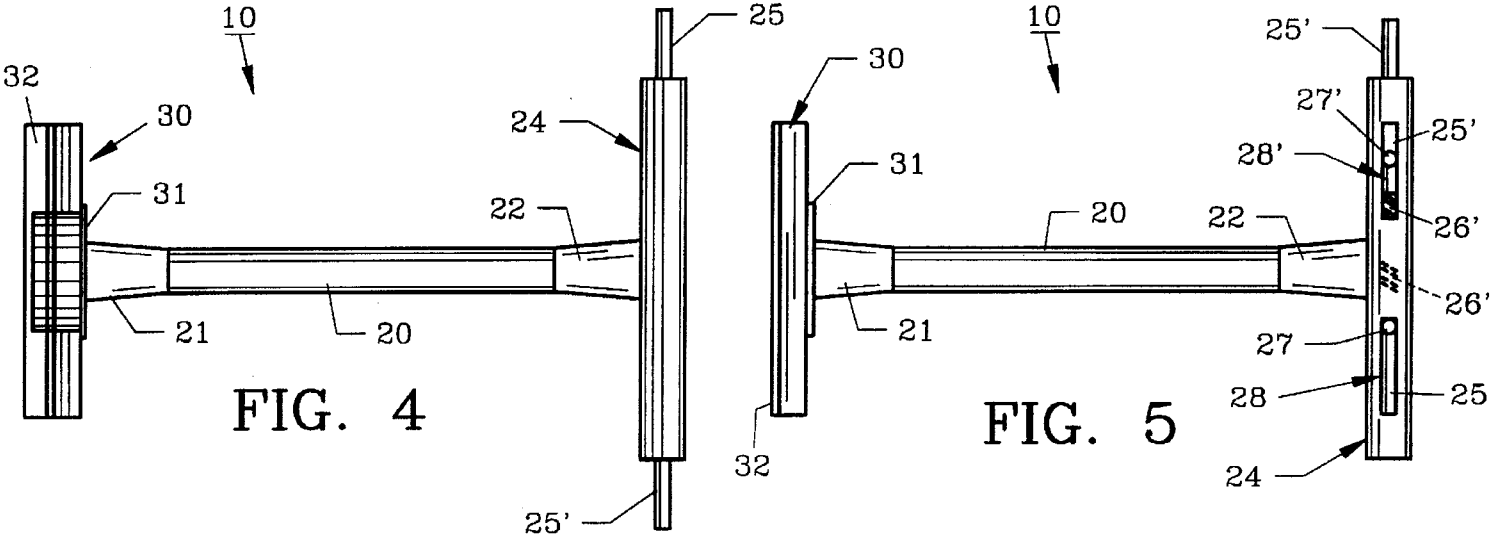
FIG. 4
FIG. 5
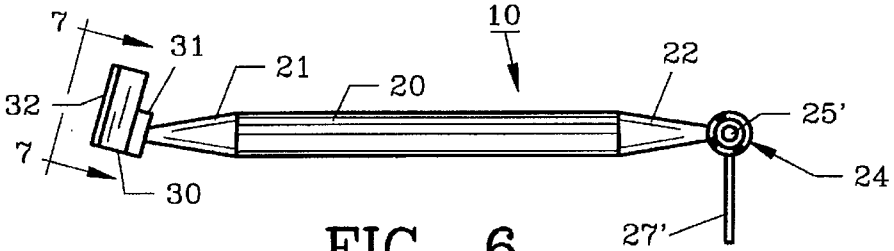
FIG. 6
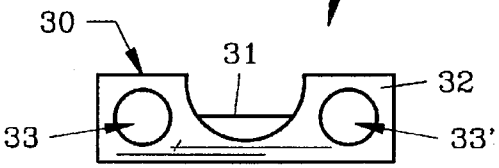
FIG. 7

OUTBOARD MOTOR SUPPORT

BACKGROUND OF THE INVENTION

1. Field of the Invention

The invention herein pertains to the stabilization of outboard motors during transportation and particularly to stabilizing outboard motors which are attached to boats during trailering.

2. Description of the Prior Art and Objectives of the Invention

During the trailering of boats having an outboard motor attached there is a potential problem of damaging the motor and/or boat if the motor is not sufficiently secure. Traveling at high rates of speeds on highways can cause vibration and shock to the boat and motor, especially if the road is not level and smooth. In addition, trailering at low speeds over bumpy, rough terrain, as must usually be done at launch sites, also has potential for causing damage to a motor that is not fully secured since it may wildly pivot from side to side.

Various types of shock absorbers and other devices have been designed in the past, such as set forth in U.S. Pat. No. 5,021,016, to help stabilize the outboard motor and prevent damage in certain instances. Such devices are time consuming to install and modifications to the boat or motor structure may be required before installation. Thus, it has been found that an outboard motor support must be easily attached and removed or else it is forgotten and left unused. With the problems and disadvantages of prior outboard motor support stabilizing devices, the present invention was conceived and one of its objectives is to provide an outboard motor support which can be quickly, conveniently installed and removed without modifying the boat or motor from its factory condition.

It is yet another objective of the present invention to provide an outboard motor support which is relatively simple in construction and low in cost yet which will eliminate trailer shock.

It is a further objective of the present invention to provide an outboard motor support which will prevent vertical and horizontal pivoting of the motor during trailering.

It is also an objective of the present invention to provide an outboard motor support that requires no modifications to the boat or motor brackets for installation.

Various other objectives and advantages of the present invention will become apparent to those skilled in the art as a more detailed description is set forth below.

SUMMARY OF THE INVENTION

A support for an outboard motor is provided which includes a tubular, longitudinal member having means to attach the support transversely positioned at each end thereof. In the preferred embodiment, the attaching means for the motor includes an angled planar plate having a plurality of openings for accepting conventional motor bolts. The attaching means for the boat in both embodiments includes a pair of spring-loaded locking pins which have handles for manually withdrawing the pins during attaching or removing the support from the apertures along the lower boat bracket.

The outboard motor support can be quickly positioned or removed as necessary and will stabilize the outboard motor during trailering and is particularly useful when trailering over rough terrains to prevent injury and damage to the motor and boat from an inadvertent swinging motor.

BRIEF DESCRIPTION OF THE DRAWINGS

FIG. 4 depicts a top plan view of the outboard motor support removed from the boat and motor for better viewing;

FIG. 5 pictures a bottom plan view of the motor support as shown in FIG. 4;

FIG. 6 presents a side elevational view of the motor support as shown in FIG. 4.

FIG. 7 features an end view of the motor support as seen in FIG. 6 along lines 7—7;

DESCRIPTION OF THE PREFERRED EMBODIMENT

Figure 1:
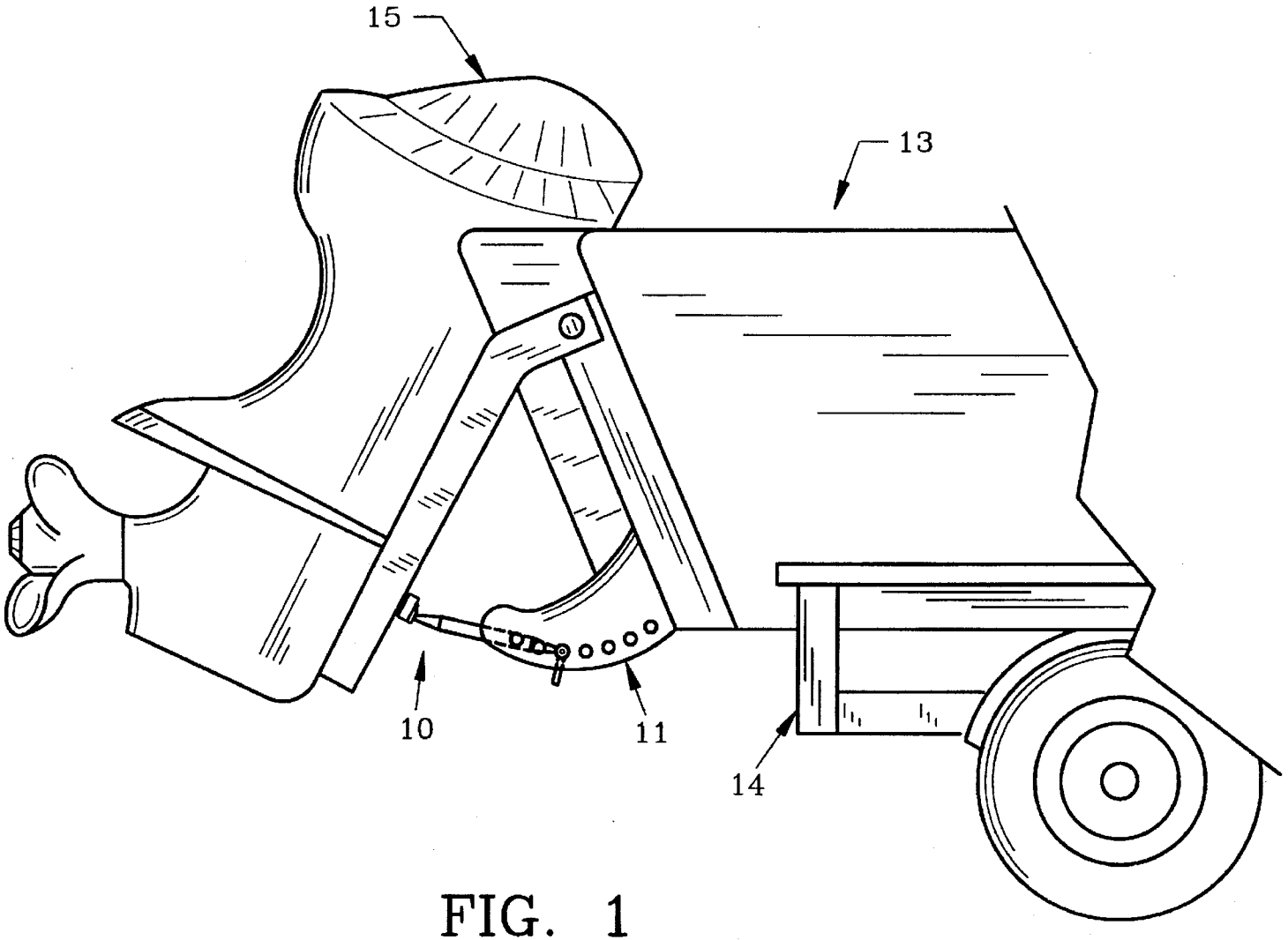
FIG. 1 demonstrates the preferred embodiment of the outboard motor support attached to a conventional outboard motor and boat with the boat and trailer seen in fragmented fashion.
Figure 2:
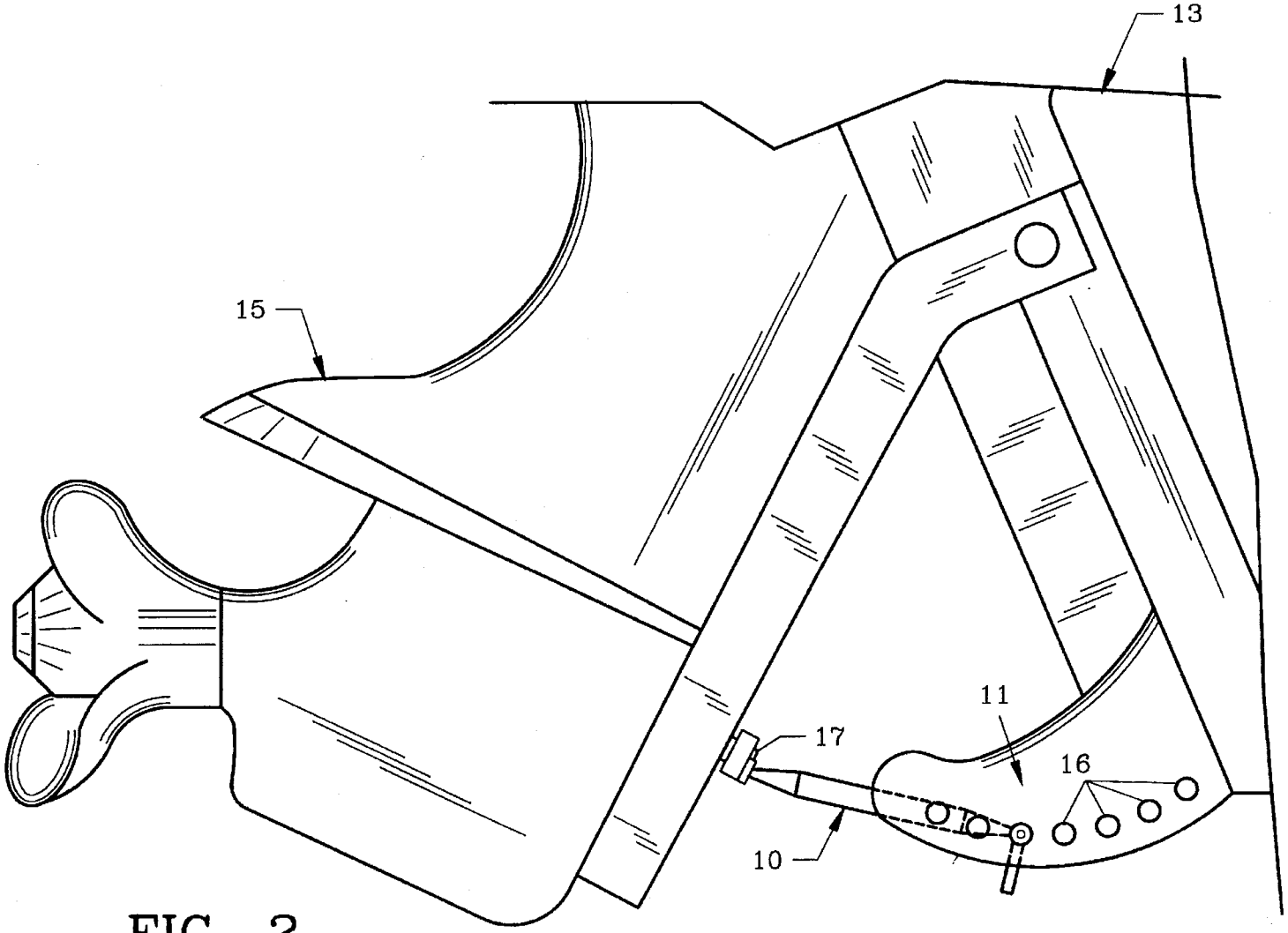
FIG. 2 shows a close-up fragmented view of the motor and support as shown in FIG. 1.

The preferred form of the invention as shown in FIGS. 1, 2 and 4–7 as used with a conventional Mercury outboard motor. The outboard motor support as shown in FIG. 2 is attached to the conventional lower boat brackets as the locking pins, as better shown in FIGS. 4 and 5, are fully extended and penetrate the apertures contained within the lower boat brackets. As would be understood, a pair of lower boat brackets are provided on opposite sides of the boat, but only one such bracket is shown in FIG. 2.

The preferred form of the outboard motor support is seen in a top plan view in FIG. 4 and includes a longitudinal center member with a lateral sleeve containing spring biased locking pins at one end and a lateral planar attaching bracket at the other end having a resilient pad. The resilient pad prevents marring of the motor bracket when attached thereto. The planar attaching bracket includes a pair of apertures as shown in FIG. 7 which engage the bolts which are standardly affixed to the outboard motor as shown in FIG. 2. When so positioned, the motor support prevents lateral or side to side pivoting movement of the outboard motor and accompanying motion which may cause damage during trailering, for example during high-speed transportation over uneven highways or along rough, unpaved roads. Each locking pin includes a handle which allows the pins to be manually withdrawn for attaching to or removing from the lower boat brackets.

DETAILED DESCRIPTION OF THE DRAWINGS AND OPERATION OF THE INVENTION

For a better understanding of the invention and its operation, turning now to the drawings, FIG. 1 shows in the preferred form, outboard motor support 10 positioned on lower boat bracket 11 which, in turn, is affixed to boat 13 positioned on trailer 14 for trailering boat 13 along a highway or the like. Outboard motor 15 is, for example, a large horsepower Mercury outboard motor which may be equipped with hydraulic controls (not shown) for movement and steering, as is standard in the industry. Support 10 requires no modifications to either boat 15 or lower bracket 11, which as shown in FIG. 2 includes a plurality of apertures 16 to allow selected placement of support 10 therealong. Motor 15 includes a pair of bolts 17 (FIG. 2) for easy attachment of support 10 to motor 15 as will be described in more detail hereinafter. Outboard motor support 10 is shown removed in more detail in FIGS. 4–7 and, as shown in FIG. 4, includes a tubular longitudinal member 20 which has been flattened at both ends 21, 22 for attachment to sleeve 24 and to planar bracket 30. In FIG. 4, sleeve 24 is affixed to longitudinal member 20 at end 22 such as by welding or the like, and contains slidable locking pins 25, 25'. Locking pins 25, 25' are spring-loaded through the use of coil springs 26, 26' and can be manipulated by handles 27, 27' shown in FIG. 5 as handles 27, 27' slide along slots 28, 28' therein. Handles 27, 27' are manually moved along slot 28, 28' respectively to withdraw pins 25, 25' during placement and removal of motor support 10. At the end of support 10 opposite sleeve 24, planar bracket 30 is shown affixed such as by welding or the like to intermediate plate 31. Planar bracket 30 is provided with guard 32 which may be formed from a somewhat resilient polymeric material to prevent marring of the outboard motor surfaces which it contacts. As seen in FIG. 6, planar bracket 30 is positioned at an angle of approximately 70° from the axis of longitudinal member 20 to accommodate the usual position of, for example, outboard motor 15 as shown in FIGS. 1 and 2. Planar bracket 30, as seen in FIG. 7, includes a pair of apertures 33, 33'. As earlier stated, apertures 33, 33' receive threaded bolts 17, 17' (17' not shown) respectively on motor 15.

In use, preferred bracket 10 is positioned on motor bolts 17, 17' as described and with finger pressure on handles 27, 27', locking pins 25, 25' are withdrawn. In FIG. 5, pin 25 is shown fully withdrawn whereas pin 25' is shown partially withdrawn by the movement of handles 27, 27'. Sleeve 24 is then slid between lower boat brackets 11, 11' (11' not shown) and with sleeve 24 properly positioned, handles 27, 27' are released allowing locking pins 25, 25' to pass through apertures 16, 16' (16' not shown). With support 10 so positioned, trailering can be conducted over highways at high speeds, rough roads, unpaved terrain or the like, without fear of damage from the pivoting and motion of motor 15 which may occur.

Figure 3:
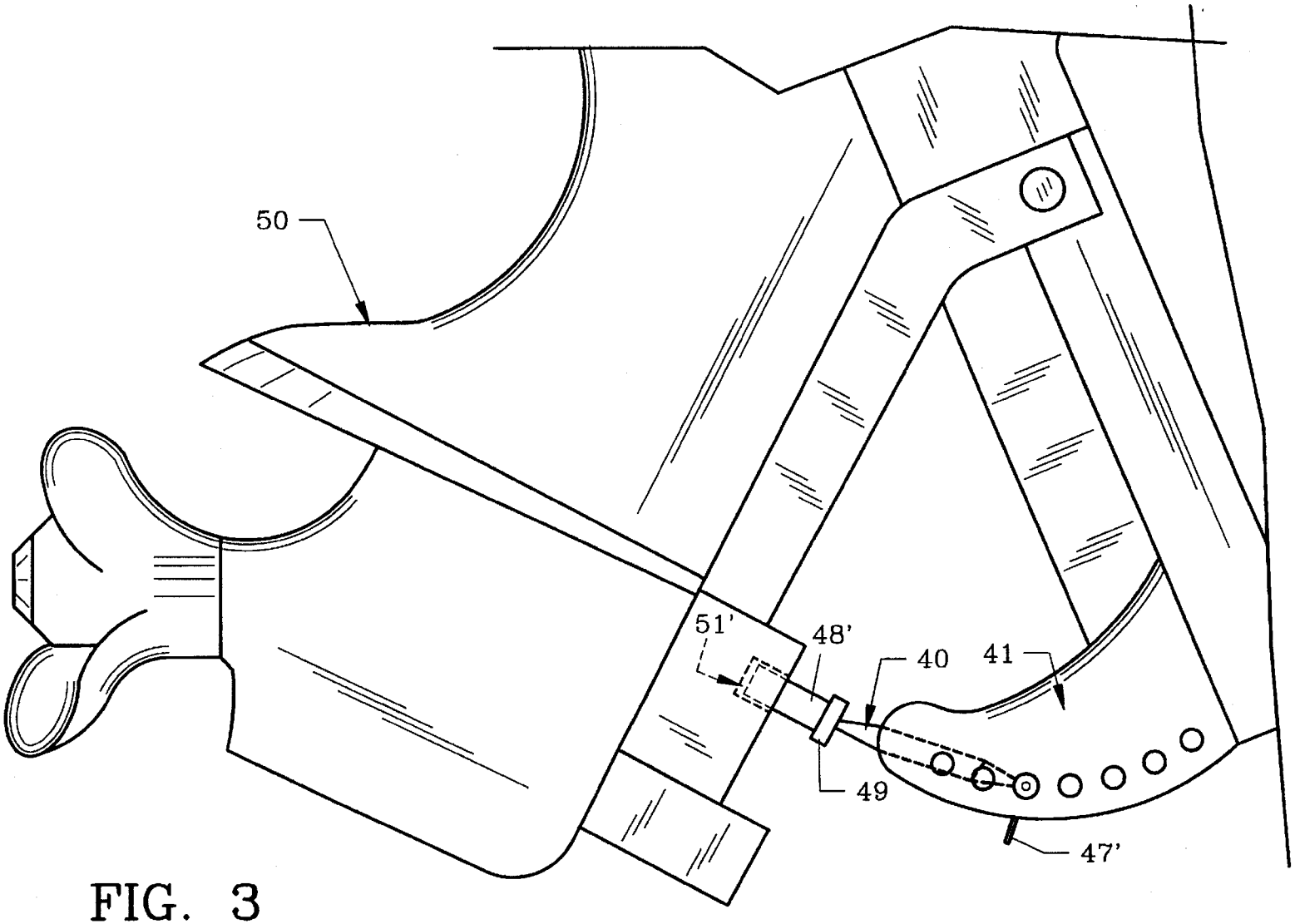
FIG. 3 illustrates a close-up alternate embodiment of the outboard motor support from that shown in FIGS. 1 and 2.
Figure 9:
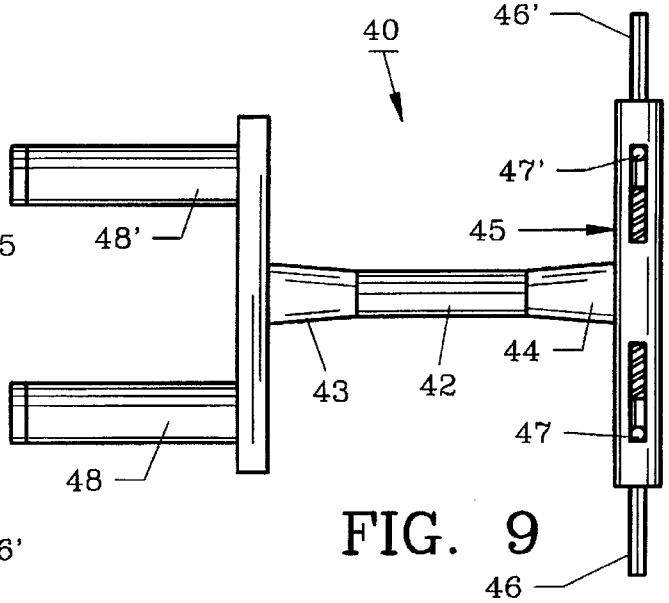
FIG. 9 is a bottom plan view of the outboard motor support as seen in FIG. 8.
Figure 8:
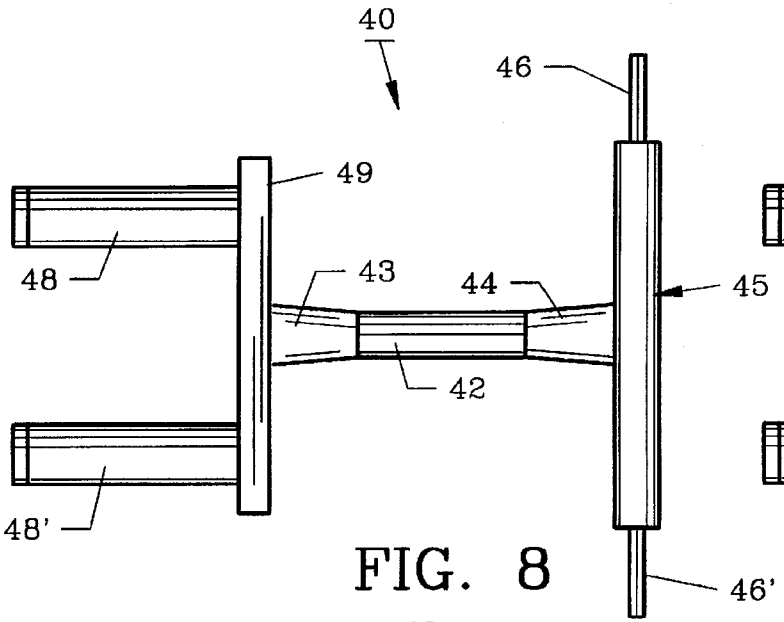
FIG. 8 shows a top plan view of an alternate embodiment of the outboard motor support as shown in FIG. 3.
Figure 10:
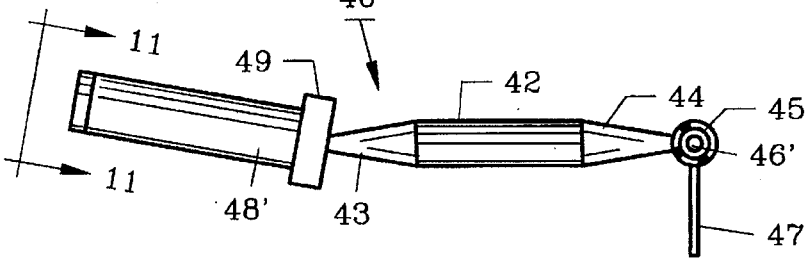
FIG. 10 reveals a side elevational view of the motor support as shown in FIG. 8.
Figure 11:
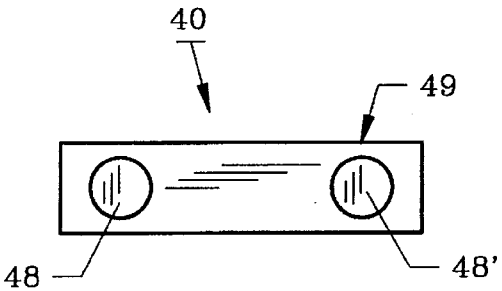
FIG. 11 displays an end view of the outboard motor support as shown in FIG. 10 along lines 11—11.

An alternate embodiment of the invention is shown in FIGS. 3 and 8–11 whereby outboard motor support 40 is shown attached to lower opposing boat brackets 41, 41' (41' not shown). As also seen in FIG. 8–11, support 40 includes central tubular longitudinal member 42 which has been flattened at ends 43, 44. Sleeve 45 is similar to sleeve 24 as described for motor support 10 in that it contains a pair of spring-loaded retractable locking pins 46, 46' and includes handles 47, 47' respectively, affixed thereto. Longitudinal member 42 is substantially shorter than its counterpart longitudinal member 20 as shown with outboard motor support 10, since the means for attaching support 40 to another conventional outboard motor is different. As seen in FIG. 3, outboard motor 50 is designed with a pair of openings 51, (not shown) 51' for receiving respectively, studs 48, 48' which are attached to planar bracket 49 (FIGS. 8–11). Studs 48, 48' are sized to easily slide into openings 51, 51' and with locking pins 46, 46' in place, cannot be inadvertently removed during transportation.

Various changes and modifications can be made by those skilled in the art and the illustrations and examples provided herein are for explanatory purposes only and are not intended to limit the scope of the appended claims.

I claim:

1. A support for an outboard motor positioned on a boat comprising: a longitudinal member, a first means to attach one end of said longitudinal member to the outboard motor, said first attaching means affixed to said longitudinal member, a second means to attach the other end of said longitudinal member to the boat, said second attaching means affixed to said longitudinal member, said second attaching means comprising a sleeve, a locking pin, said locking pin slidably contained within said sleeve, a resilient member, said resilient member contained within said sleeve for biasing said locking pin into an extended position relative to said sleeve.

2. The motor support of claim 1 wherein said first attaching means comprises a planar bracket, said planar bracket defining an aperture for receiving a bolt therethrough.

3. The motor support of claim 2 wherein said planar bracket defines a plurality of apertures, each of said apertures for receiving a bolt.

4. The motor support of claim 1 wherein said first attaching means comprises a planar bracket, a stud, said stud extending from said bracket for engaging the outboard motor.

5. The motor support of claim 1 further comprising a handle, said handle attached to said locking pin.

6. The motor support of claim 1 wherein said sleeve defines a handle slot.

7. A support for an outboard motor positioned on a boat to stabilize the motor during trailering comprising: a rigid longitudinal member, a first means to attach one end of said longitudinal member to the outboard motor, said first attaching means affixed to said longitudinal member, a second means to attach the other end of said longitudinal member to the boat, said second attaching means affixed to said longitudinal member, said second attaching means comprising a sleeve, said sleeve perpendicularly joined to said longitudinal member, said sleeve defining a pair of handle slots therealong, a pair of locking pins, said locking pins contained within said sleeve, a pair of springs, each of said springs contacting a different one of said pair of locking pins to bias the same, a pair of handles, each of said handles attached to a different one of said locking pins, said handles positioned in said handle slots for manual movement of said locking pins.

8. The support of claim 7 wherein said longitudinal member comprises a metal tube.

* * * * *